US008770319B2

(12) United States Patent
Drenth et al.

(10) Patent No.: US 8,770,319 B2
(45) Date of Patent: Jul. 8, 2014

(54) PUMP-IN SEAL

(75) Inventors: Christopher L. Drenth, Draper, UT (US); George Iondov, Milton, CA (US); George Ibrahim, Mississauga, CA (US)

(73) Assignee: Longyear TM, Inc., South Jordan, UT (US)

( * ) Notice: Subject to any disclaimer, the term of this patent is extended or adjusted under 35 U.S.C. 154(b) by 731 days.

(21) Appl. No.: 12/893,234

(22) Filed: Sep. 29, 2010

(65) Prior Publication Data

US 2011/0079433 A1 Apr. 7, 2011

Related U.S. Application Data

(60) Provisional application No. 61/247,859, filed on Oct. 1, 2009.

(51) Int. Cl.
*E21B 25/02* (2006.01)

(52) U.S. Cl.
USPC ..... 175/244; 175/246; 175/257

(58) Field of Classification Search
USPC ..... 175/58, 60, 244, 246, 247, 250, 257, 175/309
See application file for complete search history.

(56) References Cited

U.S. PATENT DOCUMENTS

| | | | | |
|---|---|---|---|---|
| D83,420 | S | 2/1931 | Baird | |
| 2,251,679 | A | 8/1941 | Kinnear | |
| 2,638,362 | A | 5/1953 | Sherman et al. | |
| D188,087 | S | 5/1960 | Rowell | |
| D194,015 | S | 11/1962 | Stringham | |
| D227,888 | S | 7/1973 | Felix | |
| 3,845,815 | A | 11/1974 | Garwood | |
| D234,847 | S | 4/1975 | Hoffman | |
| 3,989,106 | A | 11/1976 | Taylor | |
| 4,805,696 | A | 2/1989 | Henderson | |
| 4,834,198 | A | 5/1989 | Thompson | |
| D334,046 | S | 3/1993 | Klose | |
| 5,224,715 | A | 7/1993 | Downes et al. | |
| 5,267,620 | A | 12/1993 | Lee | |
| D372,516 | S | 8/1996 | Nimmo | |
| D372,765 | S | 8/1996 | Sisk | |
| D372,960 | S | 8/1996 | Allmon et al. | |
| 5,592,994 | A * | 1/1997 | Laporte et al. | 175/247 |
| D383,053 | S | 9/1997 | Schrader et al. | |
| D383,378 | S | 9/1997 | Schrader et al. | |
| 5,934,393 | A | 8/1999 | Marshall | |
| D446,298 | S | 8/2001 | Thurman | |

(Continued)

FOREIGN PATENT DOCUMENTS

| | | | |
|---|---|---|---|
| CA | 2138201 | C | 1/1997 |

OTHER PUBLICATIONS

Notice of Allowance dated Aug. 10, 2011 from U.S. Appl. No. 29/381,037, filed Dec. 14, 2010 (6 pages).

(Continued)

*Primary Examiner* — Brad Harcourt
(74) *Attorney, Agent, or Firm* — Ballard Spahr LLP

(57) ABSTRACT

An assembly may be disposed within a drill string. The assembly may be moved within and along the drill string using hydraulic pressure. A core sample may be collected within the assembly, and the assembly may be retrieved to obtain the core sample. The assembly may include a seal that may be configured to form a seal with different inner diameters of a variable-diameter drill rod of the drill string.

18 Claims, 5 Drawing Sheets

(56) References Cited

U.S. PATENT DOCUMENTS

| | | | |
|---|---|---|---|
| 6,425,449 | B1 | 7/2002 | Marshall |
| D461,545 | S | 8/2002 | Nishio |
| 6,564,885 | B2 | 5/2003 | Attwater |
| 6,681,872 | B2 | 1/2004 | Radtke et al. |
| D518,559 | S | 4/2006 | Ostergaard et al. |
| 7,380,603 | B2 | 6/2008 | Jeffrey et al. |
| 7,913,760 | B2 | 3/2011 | Robichaux et al. |
| D637,697 | S | 5/2011 | Steiner |
| D638,918 | S | 5/2011 | Grether |
| 7,975,784 | B2 | 7/2011 | Purcell |
| 2003/0121671 | A1 | 7/2003 | Bailey et al. |
| 2004/0007359 | A1 | 1/2004 | Stevens et al. |
| 2005/0199426 | A1 | 9/2005 | Smith et al. |
| 2005/0241825 | A1 | 11/2005 | Burris, II et al. |
| 2006/0037784 | A1 | 2/2006 | Walter et al. |
| 2008/0190616 | A1 | 8/2008 | Watson |
| 2010/0096132 | A1 | 4/2010 | Mosing et al. |
| 2010/0126718 | A1 | 5/2010 | Lilley |
| 2010/0206580 | A1 | 8/2010 | Tessari et al. |
| 2011/0030954 | A1 | 2/2011 | Allison et al. |

OTHER PUBLICATIONS

Notice of Allowance dated Aug. 18, 2011 from U.S. Appl. No. 29/378,943, filed Nov. 11, 2010 (6 pages).

Notice of Allowance dated Sep. 1, 2011 from U.S. Appl. No. 29/378,942, filed Nov. 11, 2010 (5 pages).

Bal Seal Engineering Company, Inc., Bal Seal Catalog, 1995, (8 pages).

Longyear Company, Longyear Heat-Treated CQ Wireline Drill Rods, 1991, (7 pages).

Longyear Company, Underground Wireline Core Barrels, Jun. 1, 1989 (4 pages).

Bal Seal Engineering Company, Inc., Rotary Seal Catalog, 2001 (7 pages).

Issue Notification dated Oct. 26, 2011 from U.S. Appl. No. 29/378,943, filed Nov. 11, 2010 (1 page).

Issue Notification dated Nov. 16, 2011 from U.S. Appl. No. 29/381,037, filed Dec. 14, 2010 (1 page).

Notice of Allowance dated Sep. 27, 2011 from U.S. Appl. No. 29/378,942, filed Nov. 11, 2010 (7 pages).

Issue Notification dated Nov. 2, 2011 from U.S. Appl. No. 29/378,942, filed Nov. 11, 2010 (1 page).

Office Action dated May 3, 2011 from U.S. Appl. No. 29/378,942, filed Nov. 11, 2010 (9 pages).

Notice of Allowance dated Apr. 27, 2011 from U.S. Appl. No. 29/378,943, filed Nov. 11, 2010 (11 pages).

Notice of Allowance dated Apr. 27, 2011 from U.S. Appl. No. 29/381,037, filed Dec. 14, 2010 (12 pages).

* cited by examiner

PUMP-IN SEAL

CROSS-REFERENCE TO RELATED APPLICATIONS

This application claims priority to and the benefit of U.S. provisional patent application Ser. No. 61/247,859, filed Oct. 1, 2009 and entitled VARIABLE LIP PUMP-IN SEAL, the disclosure of which is incorporated by reference herein in its entirety.

BACKGROUND

1. Field of the Invention

This application relates generally to drilling methods and systems.

2. Background Technology

Exploration drilling often includes retrieving a sample from a formation. The retrieved sample may then be evaluated to determine its contents.

In a conventional exploration drilling process, a drill string may be used to retrieve a sample from a formation. The drill string may include an open-faced drill bit, a core barrel, and a series of connected drill rods, which may be assembled section-by-section as the drill bit and the core barrel move deeper into the formation. The core barrel may be connected to the drill bit and the series of drill rods. In particular, the core barrel may include an outer portion and an inner portion, and a lower or leading portion of the outer portion may be connected to the drill bit, while an upper or trailing portion of the outer portion may be connected to the series of drill rods. The drill bit, the core barrel and the drill rods may be rotated and/or pushed into the formation to allow the sample (often called a "core sample") to be collected within the inner portion of the core barrel. After the core sample is collected within the inner portion of the core barrel, the core sample is retrieved by removing ("tripping out") the drill string out of the hole that was drilled ("the borehole"). In particular, each drill rod is sequentially removed from the borehole, followed by the core barrel. The core sample can then be removed from the core barrel.

In a wireline exploration drilling process, a drill string may also be used to retrieve a sample from a formation. The drill string may include an open-faced drill bit, an outer tube of a core barrel assembly, and a series of connected drill rods, which may be assembled section-by-section as the drill bit and the core barrel assembly move deeper into the formation. The outer tube of the core barrel assembly may be connected to the drill bit and the series of drill rods. The core barrel assembly may also include an inner tube assembly, which may be releasably locked to the outer tube. With the inner tube assembly locked to the outer tube, the drill bit, the core barrel assembly and the drill rods may be rotated and/or pushed into the formation to allow a core sample to be collected within the inner tube assembly. After the core sample is collected, the inner tube assembly may be unlocked from the outer tube. The inner tube assembly may then be retrieved using a retrieval system, while portions of the drill string remain within the borehole. The core sample may be removed from the retrieved inner tube assembly, and after the core sample is removed, the inner tube assembly may be sent back and locked to the outer tube. With the inner tube assembly once again locked to the outer tube, the drill bit, the core barrel assembly and the drill rods may again be rotated and/or pushed further into the formation to allow another core sample to be collected within the inner tube assembly. Desirably, the inner tube assembly may be repeatedly retrieved and sent back in this manner to obtain several core samples, while portions of the drill string remain within the borehole. This may advantageously reduce the time necessary to obtain core samples because the drill string need not be tripped out of the borehole for each core sample.

In some situations, as part of a wireline exploration drilling process, the inner tube assembly may be pumped into place using hydraulic pressure. In particular, the inner tube assembly may include a pump-in lip seal, and hydraulic pressure behind the pump-in lip seal may pump or advance the inner tube assembly along the drill string. The pump-in lip seal may be constructed from polyurethane and may include an annular lip that is configured to form a seal with drill rods having a constant inner diameter.

SUMMARY

One aspect is a drill string may include a drill bit, an outer tube of a core barrel assembly, and a series of connected drill rods. The outer tube of the core barrel assembly may be connected to the drill bit and the series of drill rods. The core barrel assembly may also include an inner tube assembly, which may be releasably locked to the outer tube. With the inner tube assembly locked to the outer tube, the drill bit, the core barrel assembly and the drill rods may be rotated and/or pushed into a formation to allow a core sample to be collected within the inner tube assembly. After the core sample is collected, the inner tube assembly may be unlocked from the outer tube. The inner tube assembly may then be retrieved, for instance using a wireline retrieval system, while portions of the drill string remain within the borehole. The core sample may be removed from the retrieved inner tube assembly, and after the core sample is removed, the inner tube assembly may be sent back and locked to the outer tube. With the inner tube assembly once again locked to the outer tube, the drill bit, the core barrel assembly and the drill rods may again be rotated and/or pushed further into the formation to allow another core sample to be collected within the inner tube assembly. The inner tube assembly may be repeatedly retrieved and sent back in this manner to obtain several core samples, while the drill bit, the outer tube, one or more of the drill rods and/or other portions of the drill string remain within the borehole.

A further aspect is the inner tube assembly may include a first seal that may be configured to form a seal with different inner diameters of a variable-diameter drill rod of the drill string. Hydraulic pressure may be used to move the inner tube assembly from a first position within the drill string to a second position within the drill string. When the inner tube assembly is at the first position within the drill string, a projection of the first seal may form a seal with a larger inner diameter of the variable-diameter drill rod and may be disposed in an expanded configuration in which the projection is radially-extended and axially-retracted. When the inner tube assembly is at the second position within the drill string, the projection of the first seal may form a seal with a smaller inner diameter of the variable-diameter drill rod and may be disposed in a compressed configuration in which the projection is radially-retracted and axially-extended.

Another aspect is an apparatus that may include a first seal. The first seal may include a central core and a lip spaced apart from the central core. The lip may include a projection that may be configured to form a seal with different inner diameters of a variable-diameter drill rod.

Yet another aspect is a method that may include disposing an inner tube assembly within a drill string. The drill string may include a variable-diameter drill rod. The inner tube assembly may include a head assembly and a first seal. The first seal may include a central core and a lip. The lip may be spaced apart from the central core. The central core may include a passageway. The passageway may receive at least a portion of the head assembly. The lip may include a projection. The projection may be configured to form a seal with different inner diameters of the variable-diameter drill rod.

Still another aspect is a method that may include disposing a first seal within a drill string. The drill string may include a variable-diameter drill rod. The first seal may include a first seal including a projection. The projection may be configured to form a seal with different inner diameters of the variable-diameter drill rod. The method may also include using hydraulic pressure to move the first seal from a first position within the drill string to a second position within the drill string.

For purposes of summarizing, some aspects, advantages and features of a few of the embodiments of the invention have been described in this summary. Some embodiments of the invention may include some or all of these summarized aspects, advantages and features. However, not necessarily all of (or any of) these summarized aspects, advantages or features will be embodied in any particular embodiment of the invention. Thus, none of these summarized aspects, advantages and features are essential. Some of these summarized aspects, advantages and features and other aspects, advantages and features may become more fully apparent from the following detailed description and the appended claims.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Figure 1:
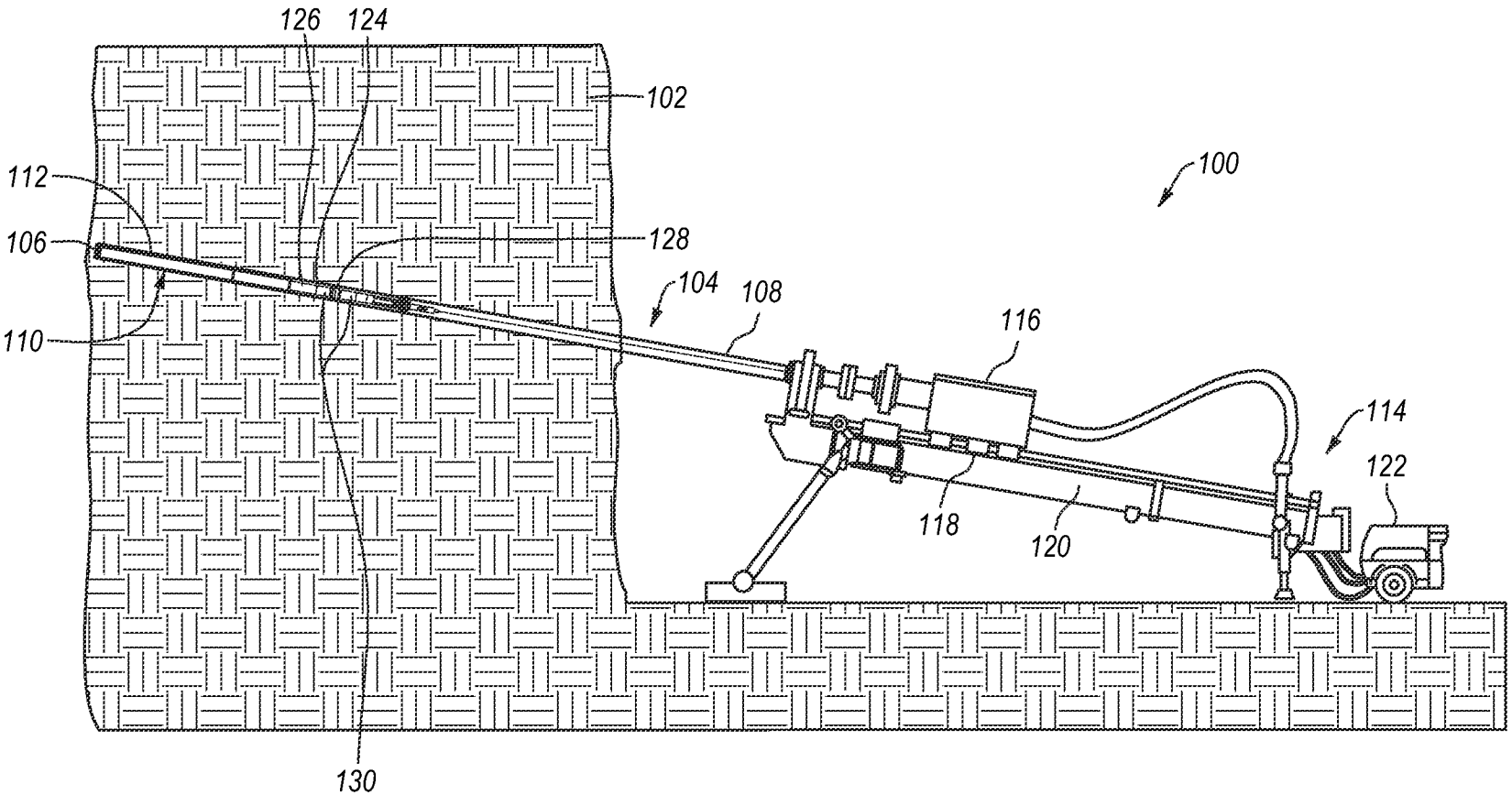
FIG. 1 illustrates an exemplary drilling system.

As shown in FIG. 1, a drilling system 100 may be used to retrieve a sample from a formation 102. The drilling system 100 may include a drill string 104 that may include a drill bit 106 (for example, an open-faced drill bit or other type of drill bit) and/or one or more drill rods 108.

The drilling system 100 may also include an in-hole assembly, such as a core barrel assembly 110, and the drill string 104 may include an outer portion of the in-hole assembly. For example, the drill string 104 may include an outer tube 112 of the core barrel assembly 110, which may be connected to the drill bit 106 and a set of one or more drill rods 108. In particular, the drill string 104 may include a reaming shell (which may interconnect the drill bit 106 and a leading portion of the outer tube 112) and an adapter coupling (which may interconnect a trailing portion of the outer tube 112 and the drill rods 108). It will be appreciated, however, that the outer tube 112 and/or other portions of the core barrel assembly 110 may be connected to the drill bit 106, the drill rods 108 and/or other portions of the drill string 104 using any other suitable components.

As part of a drilling process, the drill bit 106, the core barrel assembly 110, the drill rods 108 and/or other portions of the drill string 104 may be rotated and/or pushed into the formation 102 to form a borehole. During this process, a series of interconnected drill rods 108 may be assembled section-by-section.

The drilling system 100 may include a drill rig 114 that may rotate and/or push the drill bit 106, the core barrel assembly 110, the drill rods 108 and/or other portions of the drill string 104 into the formation 102. The drill rig 114 may include, for example, a drill head 116, a sled assembly 118, a slide frame 120 and/or a drive assembly 122. The drill head 116 may couple one or more of the drill rods 108, which may allow the drill head 116 to rotate the drill bit 106, the core barrel assembly 110, the drill rods 108 and/or other portions of the drill string 104. If desired, the drill head 116 may be configured to vary the speed and/or direction that it rotates these components. The drive assembly 122 may be configured to move the sled assembly 118 relative to the slide frame 120. As the sled assembly 118 moves relative to the slide frame 120, the sled assembly 118 may provide a force against the drill head 116, which may push the drill bit 106, the core barrel assembly 110, the drill rods 108 and/or other portions of the drill string 104 further into the formation 102, for example, while they are being rotated. It will be appreciated, however, that the drill rig 114 does not require a drill head, a sled assembly, a slide frame or a drive assembly and that the drill rig 114 may include other suitable components. It will also be appreciated that the drilling system 100 does not require a drill rig and that the drilling system 100 may include other suitable components that may rotate and/or push the drill bit 106, the core barrel assembly 110, the drill rods 108 and/or other portions of the drill string 104 into the formation 102.

The core barrel assembly 110 may include an inner tube assembly 124, which may include a receptacle (such as an inner tube 126) and a seal 128. The inner tube assembly 124 may be disposed within the drill string 104 and releasably locked to the outer tube 112. With the inner tube assembly 124 locked to the outer tube 112, the drill bit 106, the core barrel assembly 110, the drill rods 108 and/or other portions of the drill string 104 may be rotated and/or pushed into the formation 102 to allow a core sample to be collected within the inner tube 126. After the core sample is collected, the inner tube assembly 124 may be unlocked from the outer tube 112. The inner tube assembly 124 may then be retrieved, for instance using a wireline retrieval system, while the drill bit 106, the outer tube 112, one or more of the drill rods 108 and/or other portions of the drill string 104 remain within the borehole. The core sample may be removed from the inner tube 126 of the retrieved inner tube assembly 124, and after the core sample is removed, the inner tube assembly 124 may be sent back and locked to the outer tube 112. With the inner tube assembly 124 once again locked to the outer tube 112, the drill bit 106, the core barrel assembly 110, the drill rods 108 and/or other portions of the drill string 104 may be rotated and/or pushed further into the formation 102 to allow another core sample to be collected within the inner tube 126. Significantly, the inner tube assembly 124 may be repeatedly retrieved and sent back in this manner to obtain several core samples, while the drill bit 106, the outer tube 112, one or more of the drill rods 108 and/or other portions of the drill string 104 remain within the borehole. This may advantageously reduce the time necessary to obtain core samples because the drill string 104 need not be tripped out of the borehole for each core sample.

If desired, hydraulic pressure may be used to pump and/or advance the inner tube assembly 124 within the drill string 104 to the outer tube 112. In further detail, the seal 128 of the inner tube assembly 124 may be configured to form a seal with one or more portions of the drill string 104, such as, inner walls of the drill rods 108, an inner wall of the outer tube 112 and/or inner walls of other portions of the drill string 104. The seal 128 may be further configured as a pump-in seal, such that pressurized fluid pumped into the drill string 104 behind the seal 128 may cause hydraulic pressure behind the seal 128 to pump and/or advance the inner tube assembly 124 within and along the drill string 104 until the inner tube assembly 124 reaches a desired position (for instance, a position at which the inner tube assembly 124 can be connected to the outer tube 112 as discussed above). Significantly, when the drilling system 100 is used to drill a horizontal borehole or an inclined borehole, the hydraulic pressure behind the seal 128 may pump and/or advance the inner tube assembly 124 along a horizontally-oriented or upwardly-oriented drill string 104 to the desired position. Thus, the hydraulic pressure may advantageously be used in an up-hole drilling process in which the borehole is drilled at an upward angle, but also may be used in other drilling processes, if desired. The seal 128 may be further configured as a pump-in lip seal. For example, as shown in FIG. 1, the inner tube assembly 124 may further include a head assembly 130 that may be connected to the inner tube 126, and the seal 128 may be configured as a lip seal that may be connected to the head assembly 130. It will be appreciated, however, that the seal 128 need not be configured as a pump-in seal, a lip seal or a pump-in lip seal and that the seal 128 may have other suitable configurations, if desired.

As shown in FIGS. 2-5, an exemplary embodiment of the seal 128 (e.g., seal 128*a*) may include a lip 132. The seal 128*a* may also include a central core 134 that may be connected to the lip 132. As shown in FIGS. 2-5, the lip 132 may have an annular configuration. It will be appreciated, however, that the lip 132 does not require an annular configuration and may have a variety of other shapes and configurations. It will also be appreciated that the central core 134 need not be connected to the lip 132.

The central core 134 may be configured to receive and/or retain at least a portion of the head assembly 130 shown in FIG. 1 and/or other portions of the inner tube assembly 124. For example, the central core 134 may include a passageway 136 that may be configured to receive and/or retain at least a portion of the head assembly 130. The central core 134 may be configured to form a seal with the portion of the head assembly 130 that is received and/or retained by the passageway 136.

Figure 4:
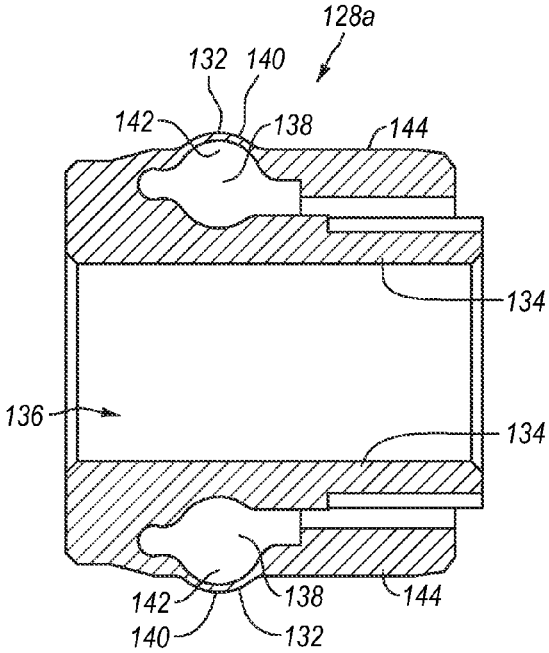
FIG. 4 is a cross-sectional view of the seal shown in FIG. 3.
Figure 5:
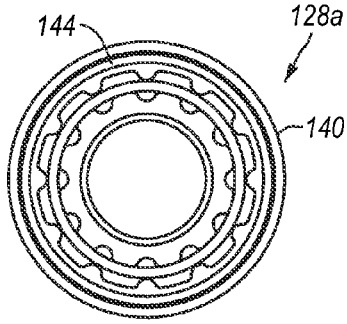
FIG. 5 is a rear view of the seal shown in FIG. 3.

As shown in FIG. 4, The lip 132 may be spaced apart from the central core 134, which may form a recess 138. The recess 138 may be disposed between portions of the lip 132 and the central core 134.

As shown in FIGS. 2-5, the lip 132 may include a projection 140. As shown in FIG. 4, the projection 140 may extend outwardly in a radial direction away from the central core 134 and may include a hollow interior portion 142 that may form at least a portion of the recess 138. The projection 140 may have an annular configuration. The projection 140 may also have a rounded section or profile when in an unloaded or uncompressed state. It will be appreciated, however, that the projection 140 does not require an annular configuration, a hollow interior portion, or a rounded section or profile and that the projection 140 may have a variety of other shapes, configurations and/or features.

The seal 128*a* may include an extension 144. The extension 144 may contact, abut, engage and/or be connected to the projection 140 and/or other portions of the lip 132. For example, the extension 144 may contact, abut, engage and/or be connected to a rear portion of the projection 140, and the extension 144 may extend rearward and/or axially from the projection 140. If desired, the extension 144 may have an annular configuration, which may contact, abut, engage and/or be connected to an annular section of the projection 140 and/or lip 132.

Figure 2:
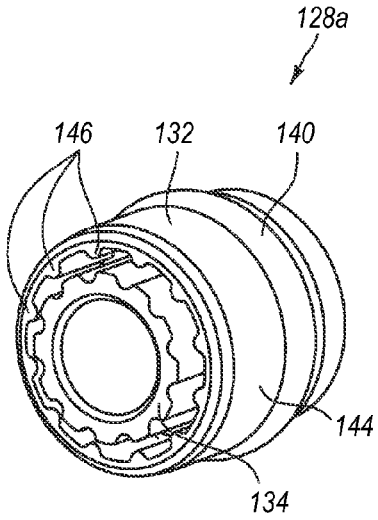
FIG. 2 is a rear perspective view of an exemplary seal.
Figure 3:
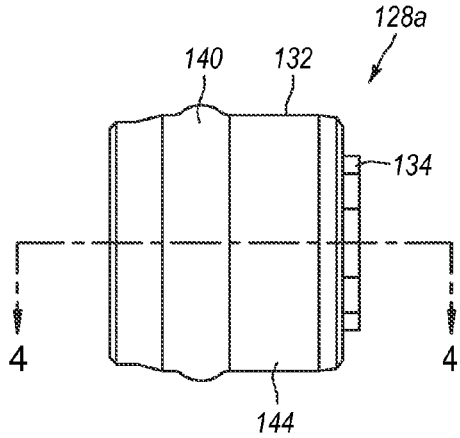
FIG. 3 is a side view of the seal shown in FIG. 2.

As shown in FIG. 2, the extension 144 may include integrally formed reinforcements, such as ribs 146, which may be axially oriented. The ribs 146 may be disposed on an interior portion of the extension 144. The ribs 146 may be spaced apart, which may advantageously help the extension 144 to compress and/or expand as the seal 128 moves within and along the drill string 104. The ribs 146, however, may be disposed in other suitable locations and may have other suitable shapes and/or orientations. Desirably, the extension 144 and/or the ribs 146 may help strengthen, reinforce and/or stiffen the seal 128 and the lip 132. It will be appreciated, however, that the extension 144 does not require any ribs or other integrally formed reinforcements.

As shown in FIG. 4, the extension 144 may be integrally formed with the projection 140 as part of a unitary, one-piece structure. For example, the extension 144 may be integrally formed with the projection 140 as part of a unitary, one-piece lip 132, which may help further strengthen, reinforce and/or stiffen the seal 128 and the lip 132. This may advantageously help prevent the seal 128 and the lip 132 from inverting, flipping or failing during use, for instance, when hydraulic pressure behind the seal 128 pumps and/or advances the inner tube assembly 124 along the drill string 104 to a desired position, as discussed above. This may be particularly advantageous when the drilling system 100 is used in shallow down-angle, horizontal, and inclined drilling processes and/or in other drilling processes.

In addition, the lip 132, the central core 134, the projection 140 and/or the extension 144 may be integrally formed as part of a unitary, one-piece structure. For example, the lip 132, the central core 134, the projection 140 and/or the extension 144 may be integrally formed as part of a unitary, one-piece structure using a material that has sufficient elasticity to form a seal with one or more portions of the drill string 104, as discussed above. In particular, the lip 132, the central core 134, the projection 140 and/or the extension 144 may be integrally formed as part of a unitary, one-piece structure using plastic (e.g., polyurethane or other plastic), an elastomer (e.g., rubber or other elastomer) and/or other suitable material.

Figure 6:
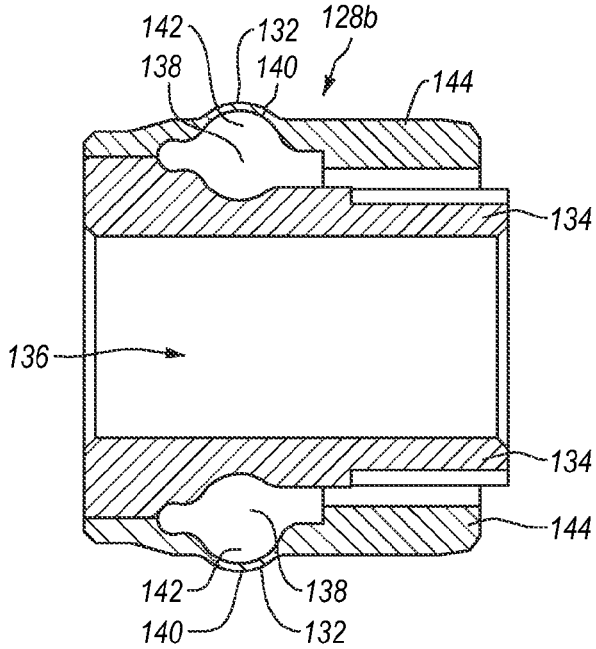
FIG. 6 is a cross-sectional view of another exemplary seal.
Figure 7:
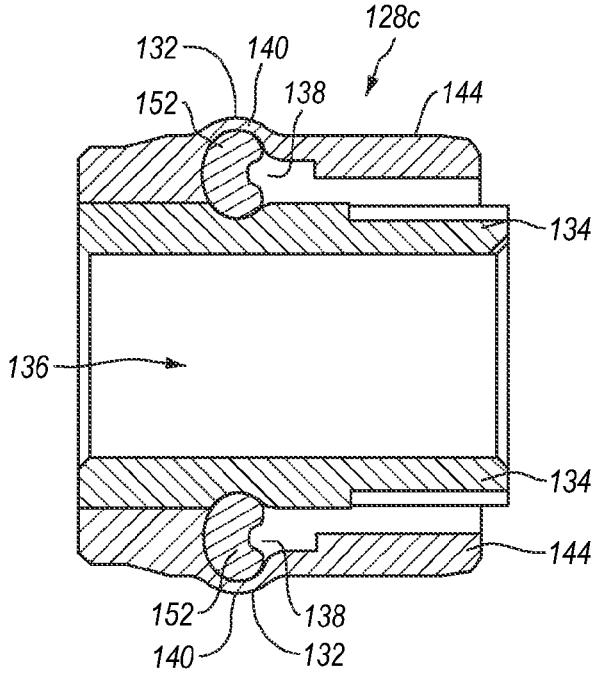
FIG. 7 is a cross-sectional view of yet another exemplary seal, illustrating an insert within a recess of the seal.

The lip 132 and the central core 134, however, need not be integrally formed as part of a unitary, one-piece structure, as illustrated by exemplary embodiments of the seal 128 shown in FIGS. 6-7. As shown in FIGS. 6-7, a seal 128*b*, 128*c* may include a lip 132, a projection 140 and an extension 144 that may be integrally formed as part of a first unitary, one-piece structure, but the seal 128*b*, 128*c* may also include a central core 134 that may be integrally formed as part of a second unitary, one-piece structure. The first and second structures of the seal 128*b*, 128*c* may be formed from the same or different materials and then subsequently assembled to form the seal 128*b*, 128*c*. In further detail, the lip 132, the projection 140 and the extension 144 may be integrally formed as part of a unitary, one-piece structure using a material that has sufficient elasticity to form a seal with one or more portions of the drill string 104, such as plastic (e.g., polyurethane or other plastic) or an elastomer (e.g., rubber or other elastomer). In addition, the central core 134 may be integrally formed as part of a unitary, one-piece structure using metal. It will be appreciated, however, that the lip 132, the projection 140, the extension 144, and the central core 134 may be constructed from other materials having other characteristics. If desired, the seals 128*b*, 128*c* may include some or all of the components and functionality of the seal 128*a* and/or other components and functionality.

Figure 8:
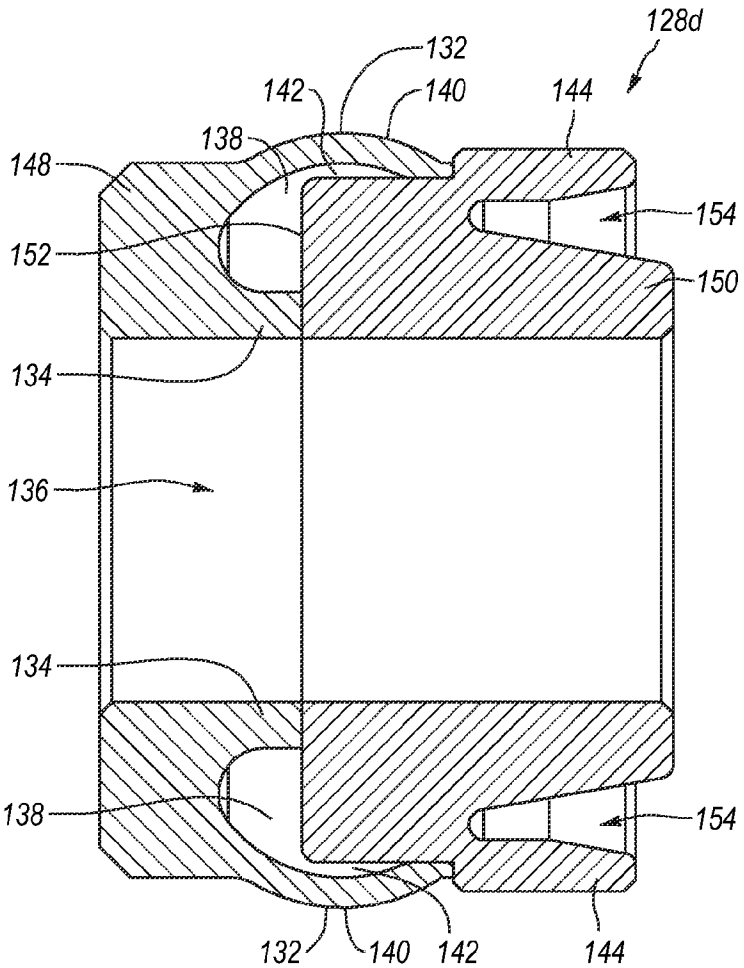
FIG. 8 is a cross-sectional view of still another exemplary seal.

Moreover, the projection 140 and the extension 144 need not be integrally formed as part of a unitary, one-piece structure, as illustrated by exemplary embodiments of the seal 128 shown in FIG. 8. As shown in FIG. 8, a seal 128*d* may include a first member 148 and a second member 150. The first member 148 may be constructed from plastic (e.g., polyurethane or other plastic) and may include the lip 132, the projection 140, at least a portion of the central core 134, and at least a portion of the passageway 136. The second member 150 may be constructed from an elastomer (e.g., rubber or other elastomer) and may include the extension 144, at least a portion of the central core 134, and at least a portion of the passageway 136. Thus, the first member 148 may be constructed from a first material having a first elasticity, and the second member 150 may be constructed from a second material having an elasticity different from the first elasticity. It will be appreciated, however, that the first and second members 148, 150 may include other components and/or may be constructed from other materials having other characteristics. If desired, the seal 128*d* may include some or all of the components and functionality of the seals 128*a*, 128*b*, 128*c* and/or other components and functionality.

As discussed above, the seal 128 may be configured to form a seal with one or more portions of the drill string 104 as the inner tube assembly 124 moves along and within the drill string 104. For example, the projection 140 of the seal 128 may be configured to form a seal with inner walls of the drill rods 108, an inner wall of the outer tube 112 and/or inner walls of other portions of the drill string 104.

Figure 9:
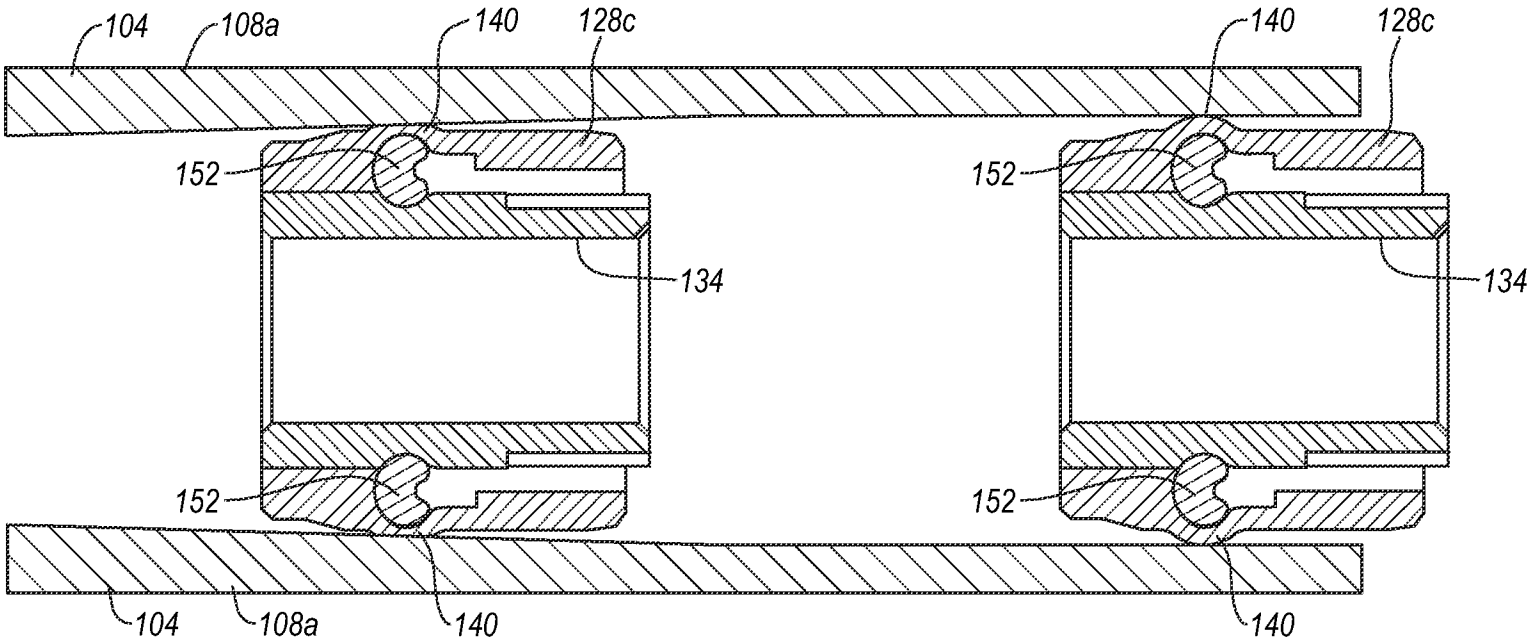
FIG. 9 is a cross-sectional view of a portion of an exemplary drilling system.

In some instances, as shown in FIG. 9, the drill string 104 may include one or more sections that have varying inner diameters, such as one or more variable-diameter drill rods 108*a*. Significantly, the variable-diameter drill rods 108*a* may have a reduced weight, which may provide advantages such as increased drilling productivity.

In such instances, when the inner tube assembly 124 moves along and within the drill string 104, the projection 140 may move among sections with larger inner diameters and sections with smaller inner diameters. Desirably, the projection 140 may be configured to form a seal with the smallest and the largest inner diameters of the various sections of the drill string 104. The projection 140 may have a diameter that is slightly larger than the largest inner diameter of the various sections of the drill string 104.

The projection 140—when it moves from a section with a larger diameter to a section with a smaller diameter—may move from an expanded configuration towards a compressed configuration. For example, when the projection 140 moves from an expanded configuration towards a compressed configuration, the projection 140 may flatten or retract radially and may extend axially.

The projection 140—when it moves from a section with a smaller diameter to a section with a larger diameter—may move from the compressed configuration towards the expanded configuration. For example, when the projection 140 moves from the compressed configuration towards the expanded configuration, the projection 140 may extend radially and may retract axially.

In some embodiments, the lip 132 and/or the projection 140 may be constructed from a material that has sufficient elasticity to bias the projection 140 from the compressed configuration towards the expanded configuration, such as plastic (e.g., as polyurethane or other plastic) or an elastomer (e.g., rubber or other elastomer).

In addition, the seal 128 may include means for biasing the projection 140 from the compressed configuration towards the expanded configuration. By biasing the projection 140 from the compressed configuration towards the expanded configuration, the means for biasing may help prevent the seal 128 and the lip 132 from inverting, flipping or failing during use—which may advantageously help maintain the seal formed between the projection 140 and the drill string 104.

One exemplary means for biasing the projection 140 from the compressed configuration towards the expanded configuration may include an insert 152 shown in FIGS. 7 and 9. At least a portion of the insert 152 may be disposed within a recess of the seal 128. For instance, at least a portion of the insert 152 may be disposed within the recess 138 recess 138 and/or the hollow interior portion 142 and may exert a force against an inner wall of the projection 140 to bias the projection 140 from the compressed configuration towards the expanded configuration. The insert 152 may include, for example, a coil spring and/or may have a generally U or C shape.

Another exemplary means for biasing the projection 140 from the compressed configuration towards the expanded configuration may include pressurized fluid. For example, as discussed above, pressurized fluid pumped into the drill string 104 behind the seal 128 may cause hydraulic pressure behind the seal 128 to pump and/or advance the inner tube assembly 124 within and along the drill string 104 until the inner tube assembly 124 reaches a desired position. At least a portion of the pressurized fluid pumped into the drill string 104 may be disposed within the recess 138 and/or the hollow interior portion 142 and may exert a force against an inner wall of the projection 140 to bias the projection 140 from the compressed configuration towards the expanded configuration.

Another exemplary means for biasing the projection 140 from the compressed configuration towards the expanded configuration may include the member 150 shown in FIG. 8. As shown in FIG. 8, the extension 144 of the member 150 may contact, abut and/or engage the lip 132 and/or the projection 140 of the member 148. By contacting, abutting and/or engaging the lip 132 and/or the projection 140, the extension 144 may exert an axial force against the lip 132 and/or the projection 140 that biases the projection 140 from the compressed configuration towards the expanded configuration. In some embodiments, pressurized fluid may be used to cause the extension 144 of the member 150 to exert this axial force against the lip 132 and/or the projection 140 of the member 148. For example, as discussed above, pressurized fluid pumped into the drill string 104 behind the seal 128 may cause hydraulic pressure behind the seal 128 to pump and/or advance the inner tube assembly 124 within and along the drill string 104 until the inner tube assembly 124 reaches a desired position. At least a portion of the pressurized fluid pumped into the drill string 104 may be disposed within one or more recesses 154, which may urge the member 150 towards the member 148 and thus cause the extension 144 of the member 150 to exert an axial force against the lip 132 and/or the projection 140 of the member 148. In some embodiments, the member 150 may include a front portion 152 that may be disposed within a recess in the member 148. For example, the front portion 152 may be disposed within a recess formed by the lip 132 and/or the projection 140. This may allow the front portion 152 to contact, abut and/or engage the inner core 134 of the member 148, which may help control the axial force that the extension 144 exerts against the lip 132 and/or the projection 140.

The methods and systems described above require no particular component or function. Thus, any described component or function—despite its advantages—is optional. Also, some or all of the described components and functions described above may be used in connection with any number of other suitable components and functions.

One skilled in the art will also appreciate that although the exemplary embodiments discussed above have been described with respect to drilling systems, these aspects and features may also be used in connection with many different processes where devices and tools are inserted into a hole or tubular member, such as well testing, oil and gas drilling operations, pipe cleaning and/or other processes.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. An apparatus comprising:
a variable-diameter drill rod comprising:
a first portion having a first, larger inner diameter; and
a second portion having a second, smaller inner diameter; and
a first seal disposed within the variable-diameter drill rod, the first seal comprising:
a central core; and
a lip spaced apart from the central core, the lip comprising:
a projection configured to form a seal with the larger and smaller inner diameters of the variable-diameter drill rod,
wherein the projection of the first seal is configured to, when forming a seal with the larger inner diameter of the variable-diameter drill rod, be disposed in an expanded configuration in which the projection is radially-extended and axially-retracted;
wherein the projection of the first seal is configured to, when forming a seal with the smaller inner diameter of the variable-diameter drill rod, be disposed in a compressed configuration in which the projection is radially-retracted and axially-extended; and
wherein the first seal further comprises means for biasing the projection from the compressed configuration towards the expanded configuration.

2. The apparatus as in claim 1, further comprising:
an inner tube assembly comprising:
a head assembly; and
the first seal;
wherein the central core of the first seal includes a passageway receiving at least a portion of the head assembly.

3. The apparatus as in claim 1, wherein the projection of the first seal has a hollow interior portion.

4. The apparatus as in claim 3, wherein the projection of the first seal has a rounded profile.

5. The apparatus as in claim 4, wherein the projection of the first seal has an annular configuration.

6. The apparatus as in claim 1, wherein the first seal further comprises:
a first unitary, one-piece structure that includes the central core and the lip; and
a second unitary, one-piece structure that includes an annular extension, the annular extension being configured to exert an axial force against the lip of the first unitary, one-piece structure to bias the projection from the compressed configuration towards the expanded configuration.

7. The apparatus as in claim 1, wherein the first seal further comprises:
a first unitary, one-piece structure that includes the central core and the lip; and
a second unitary, one-piece structure configured to, in response to pressurized fluid being pumped into a drill string that includes the variable-diameter drill rod, exert an axial force against the lip of the first unitary, one-piece structure to bias the projection from the compressed configuration towards the expanded configuration.

8. The apparatus as in claim 7, wherein the first unitary, one-piece structure is constructed from a first material having a first elasticity; and wherein the second unitary, one-piece structure is constructed from a second material having an elasticity different from the first elasticity.

9. The apparatus as in claim 1, wherein the first seal further comprises:
a unitary, one-piece structure that includes the central core, the lip, and an annular extension, wherein the annular extension of the unitary, one-piece structure extends rearward and axially from the projection of the lip.

10. The apparatus as in claim 1, wherein the first seal further comprises:
a first unitary, one-piece structure that includes the lip and an annular extension, wherein the annular extension of the first unitary, one-piece structure extends rearward and axially from the projection of the lip; and
a second unitary, one-piece structure that includes the central core.

11. A method comprising:
disposing an inner tube assembly within a drill string, the drill string including a variable-diameter drill rod, the inner tube assembly including:
a head assembly; and
a first seal including:
a central core including a passageway receiving at least a portion of the head assembly; and
a lip spaced apart from the central core, the lip including a projection configured to form a seal with different inner diameters of the variable-diameter drill rod;
using hydraulic pressure to move the inner tube assembly from a first position within the drill string to a second position within the drill string;
wherein, when the inner tube assembly is at the first position within the drill string, the projection of the first seal forms a seal with a larger inner diameter of the variable-diameter drill rod and is disposed in an expanded configuration in which the projection is radially-extended and axially-retracted;
wherein, when the inner tube assembly is at the second position within the drill string, the projection of the first seal forms a seal with a smaller inner diameter of the variable-diameter drill rod and is disposed in a compressed configuration in which the projection is radially-retracted and axially-extended; and wherein the first seal further comprises means for biasing the projection from the compressed configuration towards the expanded configuration.

12. The method as in claim 11, wherein the first seal further comprises:

a first unitary, one-piece structure that includes the central core and the lip; and a second unitary, one-piece structure configured to, in response to the hydraulic pressure, exert an axial force against the lip of the first unitary, one-piece structure to bias the projection from the compressed configuration towards the expanded configuration.

13. A method for use in a drilling process, the method comprising:

disposing a first seal within a drill string, the drill string including a variable-diameter drill rod, the first seal including:

a first seal including a projection configured to form a seal with different inner diameters of the variable-diameter drill rod; and using hydraulic pressure to move the first seal from a first position within the drill string to a second position within the drill string, wherein, when the first seal is at the first position within the drill string, the projection of the first seal forms a seal with a larger inner diameter of the variable-diameter drill rod and is disposed in an expanded configuration in which the projection is radially-extended and axially-retracted, wherein, when the first seal is at the second position within the drill string, the projection of the first seal forms a seal with a smaller inner diameter of the variable-diameter drill rod and is disposed in a compressed configuration in which the projection is radially-retracted and axially-extended, and wherein the first seal further comprises means for biasing the projection from the compressed configuration towards the expanded configuration.

14. A seal for a head assembly of a core barrel assembly, the seal comprising:

a first unitary, one-piece structure comprising:

a central core; and a lip spaced apart from the central core, the lip comprising:

a projection configured to form a seal with different inner diameters of a variable-diameter drill rod; and a second unitary, one-piece structure that includes an annular extension, wherein the second unitary, one-piece structure is configured to, in response to pressurized fluid being pumped into a drill string that includes the variable-diameter drill rod, exert an axial force against the lip of the first unitary, one-piece structure.

15. The seal as in claim 14, wherein the annular extension is configured to exert an axial force against the lip of the first unitary, one-piece structure to bias the projection from a compressed configuration in which the projection is radially-refracted and axially-extended towards an expanded configuration in which the projection is radially-extended and axially-retracted.

16. The seal as in claim 14, wherein the second unitary, one-piece structure is configured to, in response to pressurized fluid being pumped into a drill string that includes the variable-diameter drill rod, exert an axial force against the lip of the first unitary, one-piece structure to bias the projection from, a compressed configuration in which the projection is radially-retracted and axially-extended towards an expanded configuration in which the projection is radially-extended and axially-retracted.

17. The seal as in claim 16, wherein the first unitary, one-piece structure is constructed from a first material having a first elasticity; and wherein the second unitary, one-piece structure is constructed from a second material having an elasticity different from the first elasticity.

18. The seal as in claim 14, further comprising means for biasing the projection from a compressed configuration towards an expanded configuration.

* * * * *